US008544182B2

(12) United States Patent
Storjohann

(10) Patent No.: US 8,544,182 B2
(45) Date of Patent: Oct. 1, 2013

(54) ASSEMBLY FOR LEVELING NEW CONCRETE AND SUB-GRADE

(75) Inventor: Keri J. Storjohann, Johnston, IA (US)

(73) Assignee: KCK Inventions, LLC, Johnston, IA (US)

( * ) Notice: Subject to any disclaimer, the term of this patent is extended or adjusted under 35 U.S.C. 154(b) by 133 days.

(21) Appl. No.: 13/298,094

(22) Filed: Nov. 16, 2011

(65) Prior Publication Data

US 2012/0074293 A1 Mar. 29, 2012

Related U.S. Application Data

(63) Continuation-in-part of application No. 12/893,055, filed on Sep. 29, 2010, now Pat. No. 8,096,060.

(51) Int. Cl.
*G01C 9/00* (2006.01)
*G01C 15/00* (2006.01)
*G01C 21/00* (2006.01)

(52) U.S. Cl.
USPC ..... 33/518; 52/749.13

(58) Field of Classification Search
USPC ..... 33/1 LE, 518, 526, 365; 52/749.13; 404/72, 188
See application file for complete search history.

(56) References Cited

U.S. PATENT DOCUMENTS

| | | | | |
|---|---|---|---|---|
| 1,963,088 | A | 6/1934 | Heltzel | |
| 2,867,041 | A | 1/1959 | McMillan | |
| 5,033,952 | A | 7/1991 | Haug | |
| 5,173,004 | A | 12/1992 | Fahrenkrog | |
| 6,421,926 | B1 | 7/2002 | Cappuccio | |
| 6,588,164 | B1 | 7/2003 | Moblo | |
| 6,598,499 | B1 * | 7/2003 | Ernst | 81/53.2 |
| 6,719,486 | B2 * | 4/2004 | Craghan | 404/119 |
| 6,866,445 | B2 | 3/2005 | Semler | |
| 7,685,729 | B2 * | 3/2010 | Mershon | 33/521 |
| 8,096,060 | B1 * | 1/2012 | Storjohann | 33/518 |
| 8,336,275 | B2 * | 12/2012 | Rodenhouse | 52/741.3 |
| 2004/0028473 | A1 | 2/2004 | Craghan | |
| 2009/0252554 | A1 * | 10/2009 | Lura | 404/119 |
| 2011/0091277 | A1 * | 4/2011 | Biodrowski | 404/114 |

* cited by examiner

*Primary Examiner* — G. Bradley Bennett
(74) *Attorney, Agent, or Firm* — Zarley Law Firm, P.L.C.

(57) ABSTRACT

The assembly for leveling new concrete includes a driver that has a guide that is placed in a mounting structure so that the driver may be used to drive the mounting structure into the ground. The driver has both a removable rebar marker and conduit marker so that depending on whether an individual wants to use a screed pipe conduit or rebar as a support structure in their concrete the support structures are properly aligned.

3 Claims, 7 Drawing Sheets

ASSEMBLY FOR LEVELING NEW CONCRETE AND SUB-GRADE

CROSS REFERENCE TO A RELATED APPLICATION

This application is a continuation-in-part of U.S. patent application Ser. No. 12/893,055 filed Sep. 29, 2010.

BACKGROUND OF THE INVENTION

This invention relates to tools for establishing guides for placing or pouring concrete and similar work in new concrete construction such as a roadway, driveway, sidewalk, patio, bridges, decks, elevated floors, basements, parking lots and feedlots, or building floors.

In the past it was conventional practice to dig out the ground to a desired depth and then place a string line at the predetermined elevation of the finished concrete surface. Wooden stakes were then driven into the ground and pipes were laid horizontally on top of them. The upper surface of the pipes indicates the desired elevation of the finished concrete. Nails were driven into the stake tops on both sides of the pipe to keep it from rolling or being bumped off. The concrete was then poured or dumped into the desired area and struck or screed off with a strike board or screed on top of adjacent pipes. The pipes may be removed while the concrete is drying or setting and the indentations after removal of the pipes are then filled and the surface smoothed out, thus establishing a finished surface at the desired elevation of the concrete.

The use of wooden stakes with nails at their tops is inefficient, costly and time consuming compared to the material, tools and method of using them in the present invention. Wooden stakes are hard to drive so that their tops are at the required depth below the string line. They must be individually measured from the string line with a tape measure. The wooden stakes split easily when driven into the ground or when driving nails into them for holding the screed pipe. Often the accuracy is lost while driving nails stake tops in sand or soft soil conditions. In cold climates the wooden stakes swell in the concrete, causing cracks in the concrete.

To improve upon this these methods a device was formed that is seen in U.S. Pat. No. 5,173,004 to Fahrenkrog. The '004 patent presents a device with a leveling pin that was used to drive a conduit tube into the ground at a predetermined level. Then a yoke was placed in the tube so that a screed pipe conduit could be placed in the yoke at a desired location as compared to a concrete elevation finish line.

While this improved upon previous methods, problems still remain. Safety issues are presented because a user can hit his hand when driving the conduit through rock. In addition individuals desire to use other materials than conduit in concrete applications. These materials include rebar. Unfortunately, in the '004 design the driver is only effective at properly positioning a conduit. In addition the prior art assembly and method continue to have issues with cost in manufacturing the assembly.

Additional problems that need to be overcome include that current systems do not present a way to address different sizes of rebar or conduit. Further, utilizing a separate step of placing a yoke on or in a conduit after the conduit is driven in the group is time consuming and thus additional improvements are desired.

Thus, a principal object of the present invention is to provide an assembly that will account for different sizes of rebar.

Thus an object of the present invention is to provide a more efficient and accurate assembly for leveling concrete and sub-grade.

These and other objects, features, or advantages of the present invention will become apparent from the specification and the claims.

BRIEF SUMMARY OF THE INVENTION

An assembly for leveling new concrete and sub-grade that has a driver with a metal insert. The driver also includes a rebar marker and a conduit marker at separate locations on the driver that both determine a vertical placement of a yoke. The yoke is slidably and detachably connected to the driver such that the yoke can be placed over a mounting structure in order to drive the mounting structure into the ground. Once the mounting structure is driven into the ground the drive and yoke are separated or detached thus leaving the yoke in place to receive a support structure such as rebar.

DETAILED DESCRIPTION OF THE PREFERRED EMBODIMENT

Figure 1:
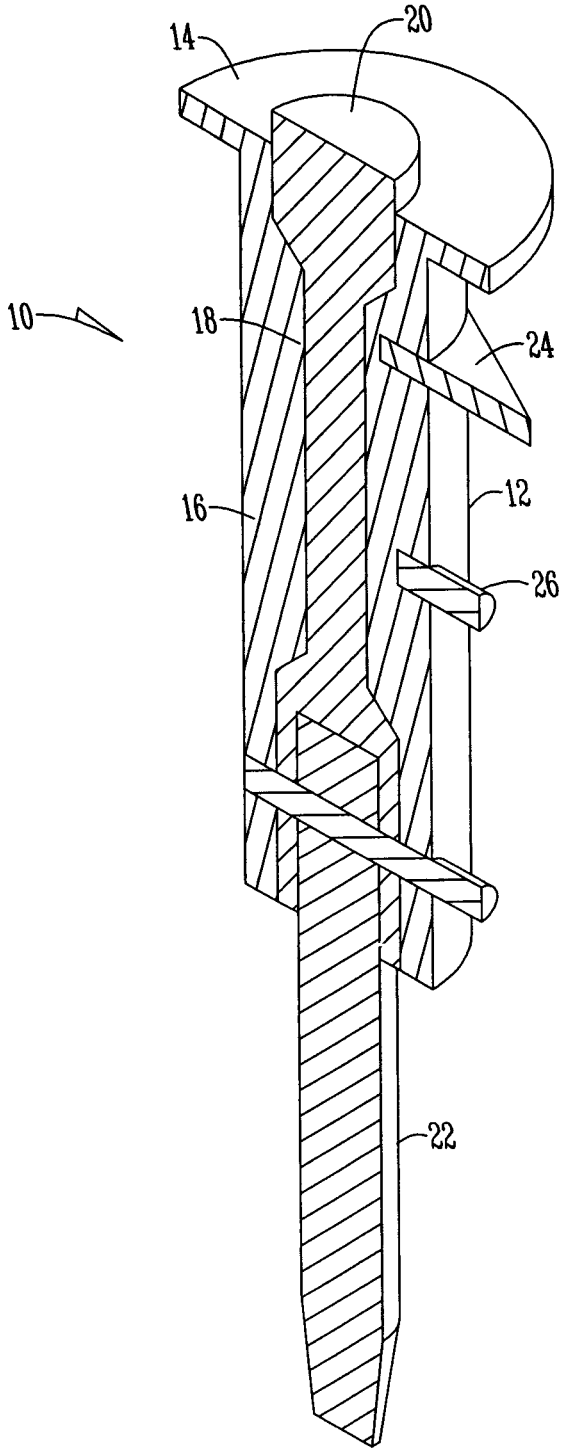
FIG. 1 is a side sectional view of the driver.
Figure 2:
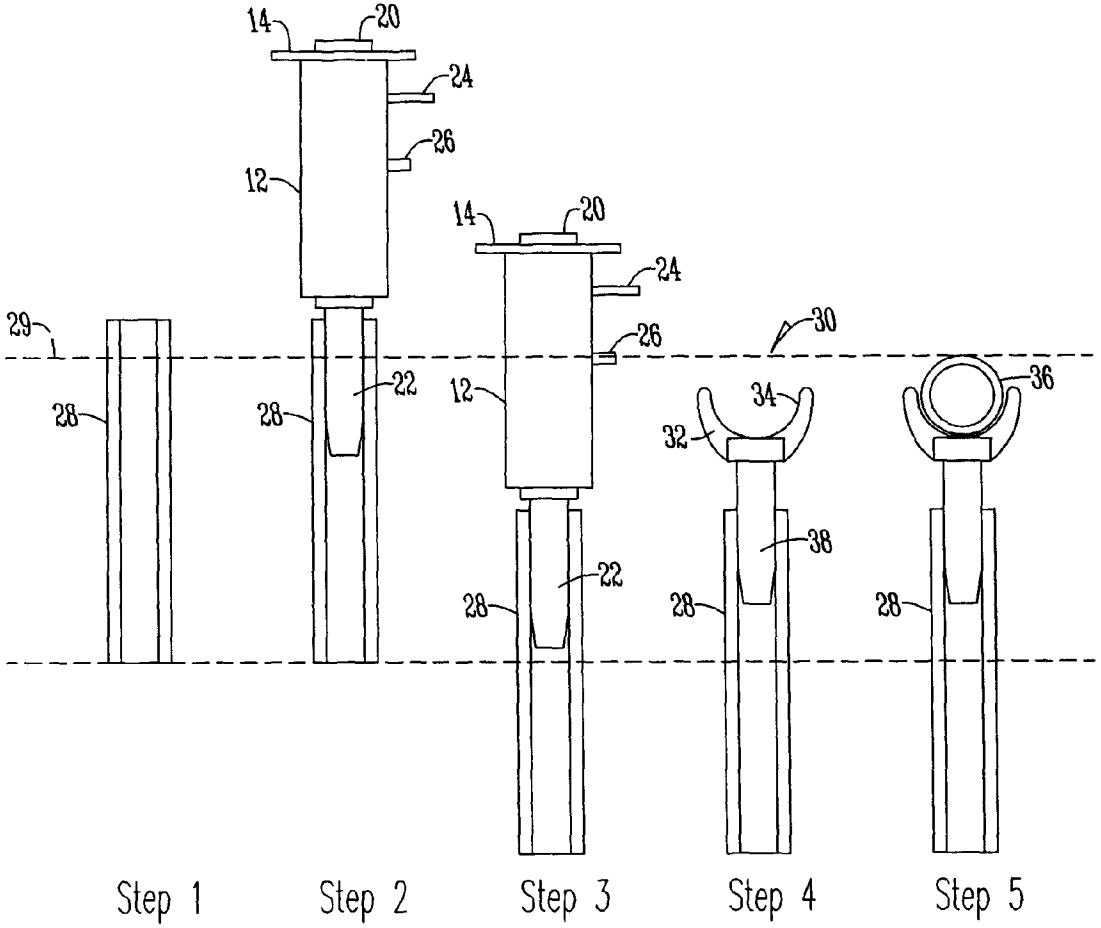
FIG. 2 is a side view of a series of drivers, yokes and mounting structures, illustrating the various steps in the procedure utilized to place screed pipe conduit in place.
Figure 3:
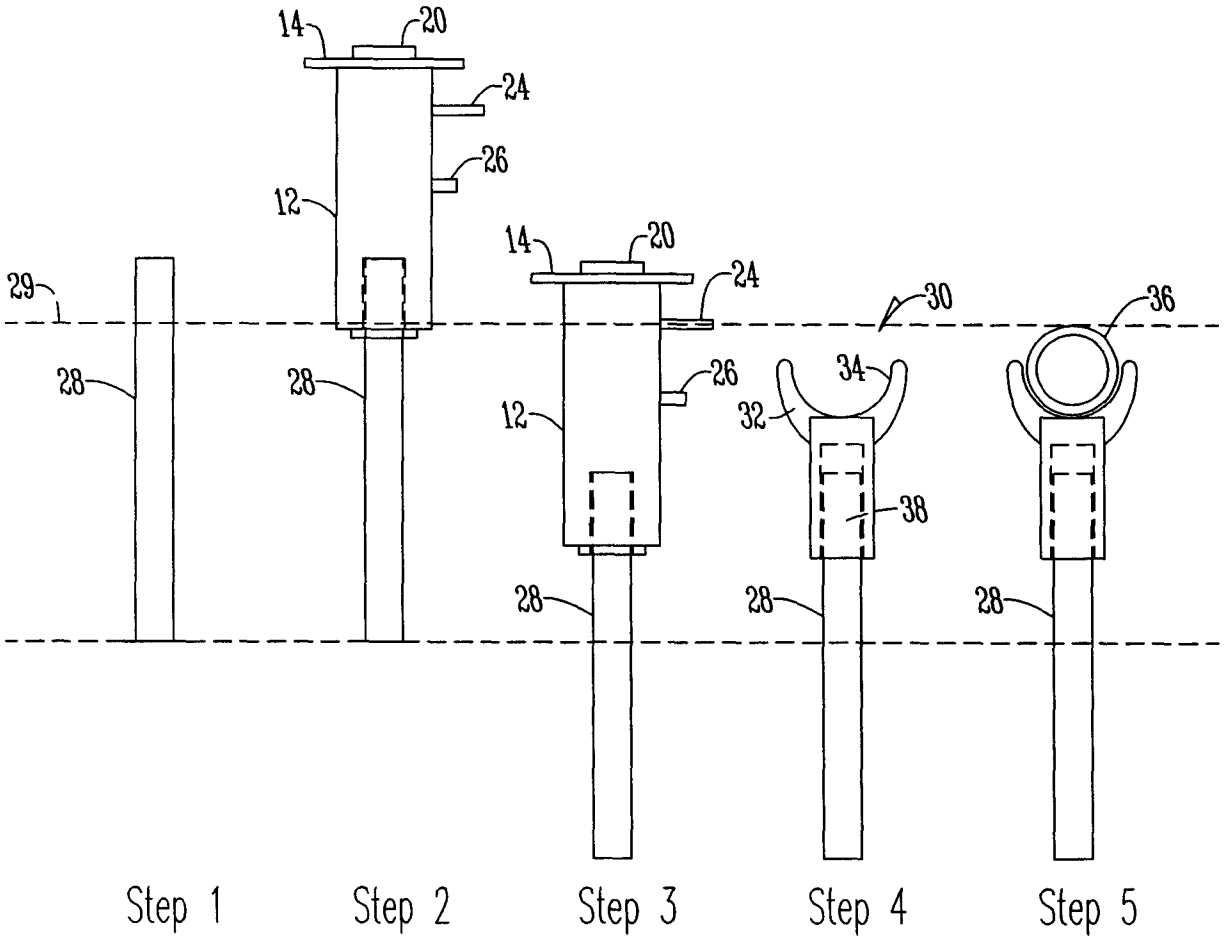
FIG. 3 is a side view of a series of drivers, yokes and mounting structures, illustrating the various steps in the procedure utilized to place rebar in place.
Figure 4:
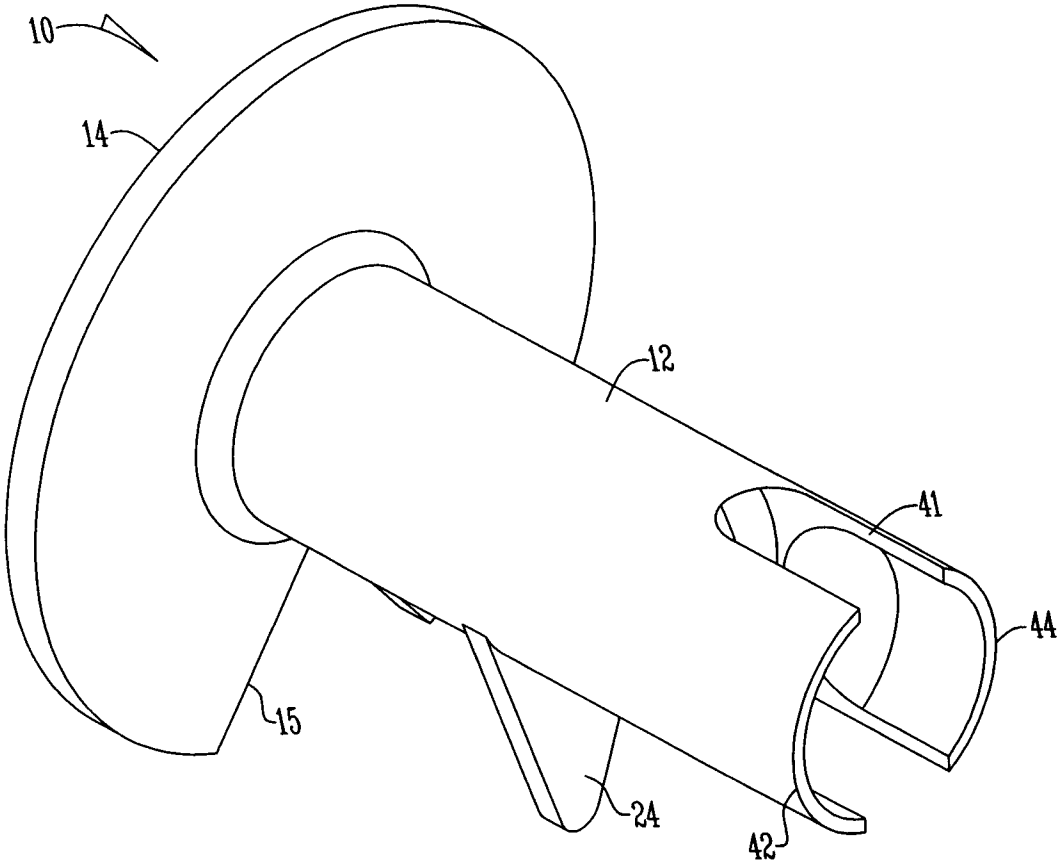
FIG. 4 is a perspective view of a driver.

The figures show a driver 10 that consists of an elongated body 12 that has a safety shield 14 with an opening 15 at a first end and has a bore 16 that receives an insert 18 that also has a head 20. In a preferred embodiment the elongated body 12 is made of plastic or nylon while the insert 18 is made of steel or metal. Additionally the head 20 of the insert 18 engages the top of the head 14 of the elongated body 12 to lock the insert 18 within the elongated body 12. Extending through the elongated body 12 and from the insert 18 is a guide or removable post 22.

The driver 10 additionally has a rebar marker 24 and a conduit marker 26. In the embodiment as shown in the figures both the rebar marker 24 and conduit marker 26 are removably disposed through the elongated body 12 and into the insert 18 to secure the markers 24 and 26 therein. The markers 24 and 26 additionally align with the opening 15 of the head 14 of elongated body 12 so that when an individual is hammering the driver 10 they can look through the opening 15 to determine the position of a marker 24 or 26 being used.

The driver 10 is used to drive a mounting structure 28 into the ground at a predetermined height. In one embodiment the mounting structure 28 is a hollow tube that receives the guide 22 whereas alternatively the mounting structure 28 can be rebar where the insert 18 receives the rebar. A string line 29 or laser is then used to present a straight line to establish a height of the finished concrete or sub-grade and the markers 24 or 26 are used to align with the string line 29. The driven head 20 is hammered downward until a marker 24 or 26 aligns and then the next mounting structure 28 can be placed.

Once the mounting structure 28 drives the conduit into the ground at a predetermined height a yoke 30 is placed into the mounting structure 28. The yoke 30 has a cradle 32 and an arcuate loop 34 and is of a size and shape to receive a support body 36 such as screed pipe or rebar. In addition in the embodiment where the mounting structure is a conduit tube the yoke 30 has a tube or stem 38 extending therefrom that extends into the mounting structure 28 to hold the yoke 30 in place. In the embodiment where the mounting structure is rebar, the yoke fits over the rebar accordingly. In a preferred embodiment the yoke and stem 38 have a plurality of indentations 40 in order to reduce the amount of materials needed to manufacture the yoke 30. In yet another embodiment the stem 38 is threaded so that a nut can be used for precise height placement and accuracy. Again, this eliminates materials and provides a more secure connection in the mounting structure 28.

Figure 5:
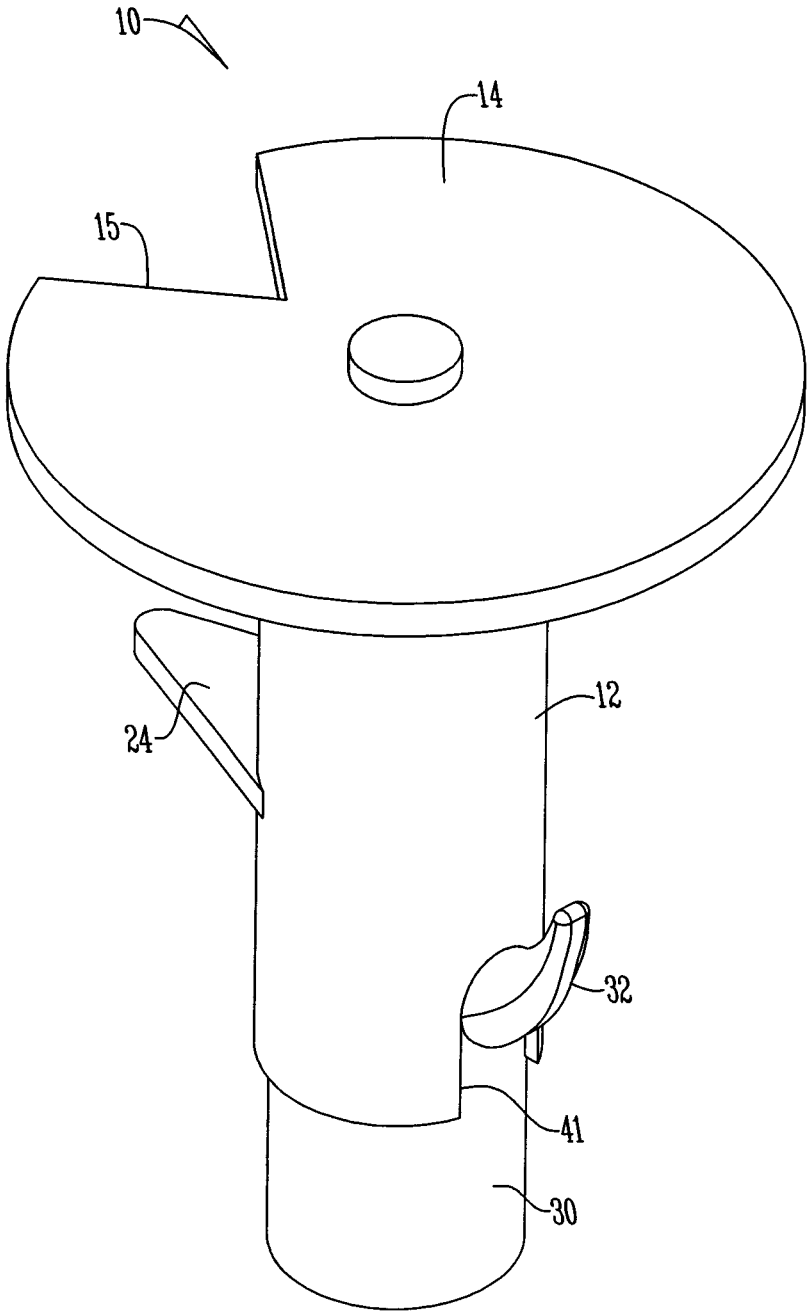
FIG. 5 is a perspective view of a driver and yoke.

An alternative embodiment is best shown in FIGS. 4-7 where the driver 10 and yoke 30 can be detachably or slidably connected to one another such that the yoke assists in the driving of the mounting structure 28 into the ground. In this embodiment the elongated body 12 has a slot 41 disposed therein at an end opposite the end having the safety shield 14. The slot 41 in a preferred embodiment is generally arcuate in shape and is formed to create first and second arcuate flanges 42 and 44 that are formed at the end of the elongated body 12. The slot 41 is thus designed to specifically receive the cradle 32 of the yoke 30 as best shown in FIG. 5.

Figure 6:
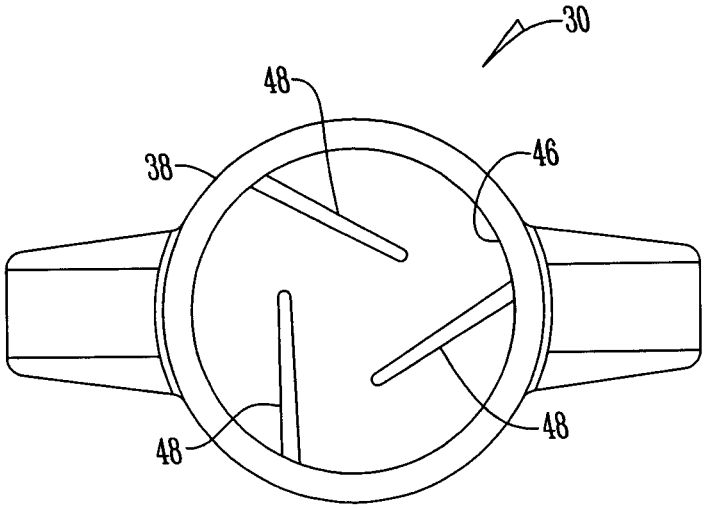
FIG. 6 is a bottom perspective view of a yoke.
Figure 7:
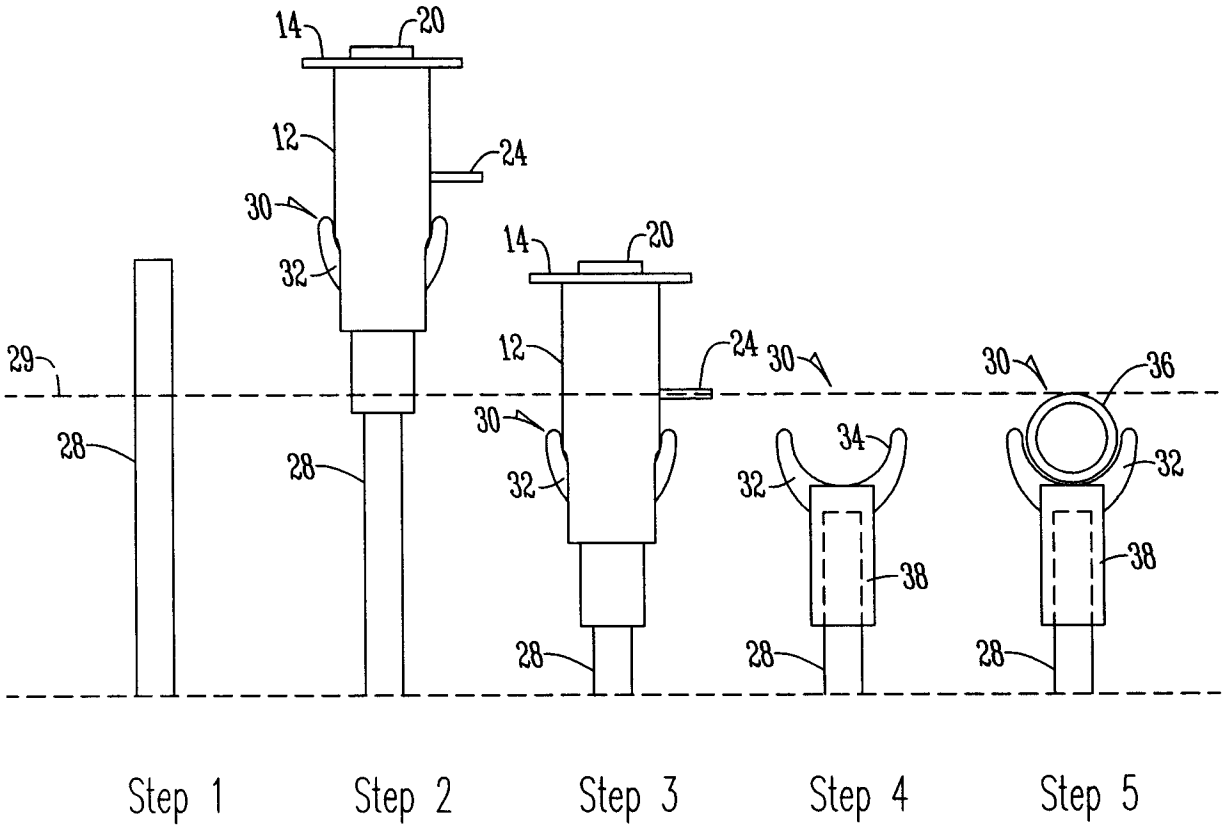
FIG. 7 is a side view of a series of drivers, yokes and mounting structures, illustrating the various steps in the procedure utilized to place rebar in place.

As shown in FIG. 6 the yoke 30 has a support body 36 with a hollow interior 46 that has a plurality of flexible connection members 48 that in one embodiment can be considered fins. The flexible connection members 48 extend from an interior sidewall of the support body 36 inwardly and are made of a flexible or elastic material. In this manner the flexible connection members 48 can flex or bend to accommodate different size mounting structures 28.

In operation an individual determines whether they will use conduit, rebar or other support structure when making their concrete. Thus if they use the rebar an individual inserts the rebar marker 24 into the driver 10. At this time the individual places the guide 22 into the mounting structure 28 and hammers the head 20 of the insert 18 of the driver 10 until the marker 24 lines with a string line 29. The driver 10 is then removed and the yoke 30 is placed within the mounting structure 28 such that rebar may be placed in the yoke 30. In this manner the rebar marker 24 determines the vertical placement of the yoke 30 for the rebar or support body 36.

When a user decides to use conduit as the support structure 36 the rebar marker 24 can be removed and a conduit marker 26 placed within the driver 10. Then again at this time the driver 10 can then be used to hammer the mounting structure 28 into the ground until the conduit marker 26 aligns with the horizontal string line 29. The driver may then be removed so that the yoke 30 that supports the screed pipe conduit can be placed in the mounting structure 28 to receive the conduit. In this manner the driver 10 utilizes the conduit marker 26 to determine a vertical placement of the yoke 30 for such conduit.

In the embodiment as seen in FIGS. 4-7 in operation the yoke 30 is detachably and slidably connected to the driver 10 by sliding the arcuate slot 40 over the cradle 32. At this time, or at a time prior to connecting the driver 10 and yoke 30, the support body 36 of the yoke 30 is placed over a mounting structure 28 such that the flexible connecting members 48 flex in order to accommodate the mounting structure 28 regardless of the diameter of the mounting structure 28. Once the yoke 30 engages the mounting structure 28 and the driver 10 is connected to the yoke 30 and individual drives the mounting structure 28 into the ground as previously discussed above. Once in place the driver 10 merely needs to be detached or slidably removed from the yoke 30 and the yoke 30 is able to receive support structure 36 as discussed above without additional steps.

Thus presented is an assembly for leveling new concrete or sub-grade that allows for both the proper placement of rebar and conduit. Specifically, by having the interchangeable rebar and conduit markers 24 and 26 either type of support structure 36 may be properly aligned. In addition because of the opening 15 in the head 14 of the elongated body 12, faster, a safety shield may be utilized for additional protection. In addition because of the indentations 40 and structure of the yoke 30 and stem 38 less material is used eliminating manufacturing costs. Further, by having an insert 18 that is made of steel within a plastic or nylon housing or elongated body 12, again a more accurate and safe design is presented that minimizes concrete cracking and other problems associated with the prior art. Also, the embodiment of FIGS. 4-7 include flexible connection members that allow the yoke 30 to be attached to varying sized mounting structures 28 and further by presenting a detachable connection between the driver 10 and yoke 30 the speed and efficiency is improved. Thus at the very least all of the stated objectives have been met.

It will be appreciated by those skilled in the art that other various modifications could be made to the device without the parting from the spirit and scope of this invention. All such modifications and changes fall within the scope of the claims and are intended to be covered thereby.

What is claimed is:

1. An assembly for leveling new concrete comprising:

a driver having a rebar marker that determines a vertical placement of a yoke for rebar;

said driver having a conduit marker for determining a vertical placement of the yoke for the conduit; and said yoke engaging a mounting structure and detachably connected to the driver such that once the mounting structure is driven into the ground by the driver the yoke is detached from the driver to form a support structure.

2. The assembly of claim 1 wherein the yoke has a hollow support body that surrounds the mounting structure.

3. The assembly of claim 2 wherein the hollow support body has a threaded interior that receives the mounting structure.

* * * * *